US009217242B1

(12) United States Patent
Jones

(10) Patent No.: US 9,217,242 B1
(45) Date of Patent: Dec. 22, 2015

(54) SYSTEM FOR REMOTE FIRE HYDRANT RECONNAISSANCE

(71) Applicant: Keith Jones, Seal Beach, CA (US)

(72) Inventor: Keith Jones, Seal Beach, CA (US)

( * ) Notice: Subject to any disclaimer, the term of this patent is extended or adjusted under 35 U.S.C. 154(b) by 121 days.

(21) Appl. No.: 14/202,644

(22) Filed: Mar. 10, 2014

(51) Int. Cl.
*G08B 5/22* (2006.01)
*G08B 5/00* (2006.01)
*E03B 9/04* (2006.01)

(52) U.S. Cl.
CPC ..... *E03B 9/04* (2013.01)

(58) Field of Classification Search
None
See application file for complete search history.

(56) References Cited

U.S. PATENT DOCUMENTS 4,929,936 A 5/1990 Friedman et al.
6,260,507 B1 * 7/2001 Simpson ..... E03B 9/06 116/200
D488,575 S 4/2004 Aguilera
6,758,160 B1 7/2004 Martin
7,940,166 B2 5/2011 Koliopoulos
8,614,745 B1 * 12/2013 Al Azemi ..... H04N 7/183 348/159
2006/0032939 A1 2/2006 Relyea
2007/0120664 A1 5/2007 Bilbrey
2009/0128355 A1 * 5/2009 Urbin ..... G08B 5/00 340/815.4
2009/0174542 A1 7/2009 Gentry et al.
2011/0121734 A1 5/2011 Pape
2012/0261002 A1 * 10/2012 Sampson ..... E03B 9/04 137/296

FOREIGN PATENT DOCUMENTS

JP 07109712 A 4/1995

* cited by examiner

*Primary Examiner* — Brian Zimmerman
*Assistant Examiner* — Thomas McCormack
(74) *Attorney, Agent, or Firm* — Patent Law & Venture Group; Gene Scott

(57) ABSTRACT

Fire hydrants each have a band of lamps strapped around them, the lamps powered by a solar collector battery circuit. An RF signal is transmitted to a receiver in the circuit by a remote responder causing the lamps to light up with a coded color related to the water flow rating of each of the hydrants and with a blink rate related to the water pressure of each of the hydrants. Upon arriving at the fire scene responders are able to select an appropriate hydrant for the location and size of the fire. The circuit is able to transmit flow and pressure information to the responders which information is presented on a display screen for early reconnaissance of the water resources at the fire scene.

14 Claims, 6 Drawing Sheets

SYSTEM FOR REMOTE FIRE HYDRANT RECONNAISSANCE

BACKGROUND

The technical field of this disclosure relates to the general subject of fire-fighting, and more particularly to a reconnaissance apparatus and method for remotely identifying the location, flow rating and water pressure of fire hydrants within a local area.

A fire hydrant, also known colloquially as a fire plug in the United States, provides a means for active fire protection as a source of water. Such apparatus are provided in most urban, suburban and rural areas with municipal water service to enable firefighters (responders) to tap into the municipal water supply to assist in extinguishing fires. One of the first challenges that responders face when they arrive at the scene of a fire is finding a suitable water source that provides enough water for the type of fire they face. In each situation, responders use standardized formulas to estimate the amount of water needed to suppress a fire. Fire hydrants are commonly color coded to indicate the maximum water flow rate they can provide in gallons per minute (GPM). Hydrant maximum water output varies from 500 GPM or less to over 2500 GPM depending on the supply system and the type of hydrant. In an effort to make it easier for responders to know what a specific hydrant will supply, the National Fire Protection Agency (NFPA) recommends that fire departments and water districts follow a set standard of color-coding. Hydrants using public water supply systems should be painted chrome yellow, and their tops and caps should indicate the available GPM. Recommended code includes: <500 GPM (red), 500-999 GPM (orange), 1000-1499 GPM (green), and ≥1500 GPM (blue). The Occupational Safety and Health Administration (OSHA) further recommends that a hydrant be painted violet for any source that is non-potable. If a hydrant is inoperable it is recommended that it be painted black. Hydrants are also rated in pressure units such as pounds per square inch (PSI). All hydrants are assumed to provide at least 20 PSI. If a given hydrant does not meet NFPA recommendations, the rated pressure should be stenciled on the top of the hydrant and on its caps. They also recommend this for extremely high pressure hydrants which can cause damage to firefighting equipment if precautions are not taken.

Although the locations of fire hydrants are identified on maps, it may be difficult to locate or find a particular hydrant due to darkness, fog, mist, snow or surrounding vegetation. Also, a hydrant may be out of order or actually missing due to recent changes not portrayed on maps. Therefore, there is a need for improving the ability for fire fighters to quickly locate and characterize hydrants in the near vicinity of an existing fire. The presently described apparatus and method of use is an answer to this need providing the ability to locate and identify flow rate and pressure characterization of locally available hydrants quickly prior to arriving on the scene of a fire thereby saving precious moments and potential confusion as to which hydrant(s) to use, especially at night or at other times of low-visibility.

It is known in the prior art to provide a fire hydrant strap-on solar powered device having lamps for signaling an emergency situation through selective colored beams and which may be activated by a responder wirelessly, and where color coding indicates the distance and direction of the hydrant from the transmitter and the hydrant flow rate and other hydrant characteristics. When a responder is approaching a fire it is important to enable fast reconnaissance of the vicinity of the fire. Therefore, it is important to know exactly where all fire hydrants are located relative to the fire and to also know the flow and pressure characteristics of the hydrants. The prior art does not provide a complete solution to this need. The present apparatus and method of operation provides an elegant, novel solution.

BRIEF DESCRIPTION OF DRAWINGS

Like reference symbols in the drawing figures indicate like elements.

DETAILED DESCRIPTION

Figure 1:
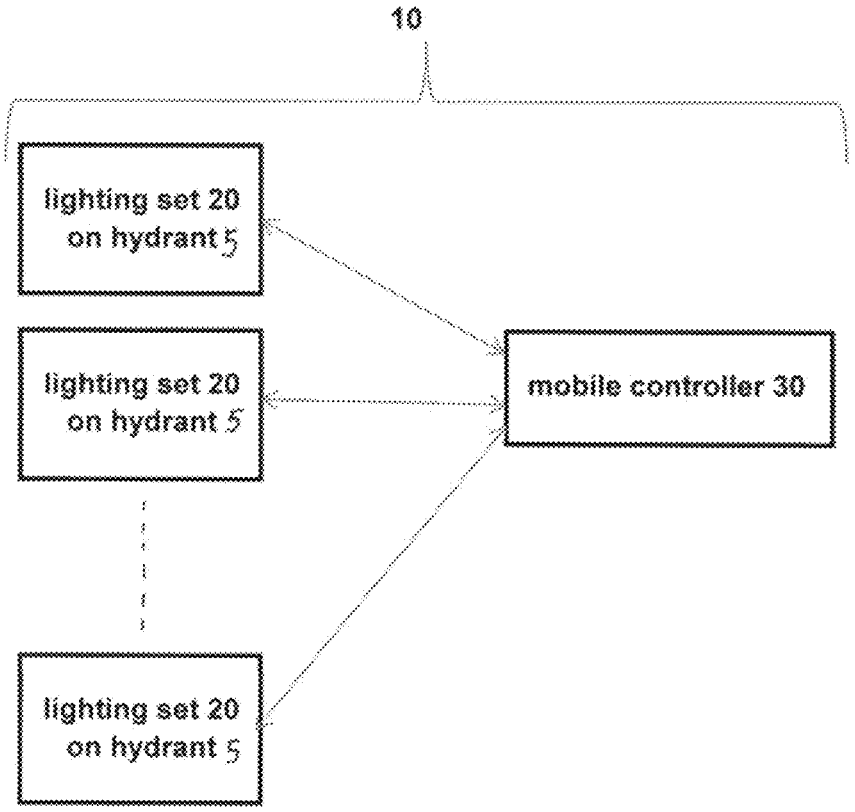
FIG. 1 is an example block diagram of the presently described apparatus.

As shown in FIG. 1, the presently described reconnaissance system 10 includes one or more lighting sets 20 and a mobile controller 30. Elements 20 and 30 communicate with each other via digital radio frequency (RF) transmission. The arrows in FIG. 1 represent wireless transmission channels. In an embodiment, the controller 30 sends RF signals to one or more lighting sets 20 and not signals are sent from sets 20.

Figure 2:
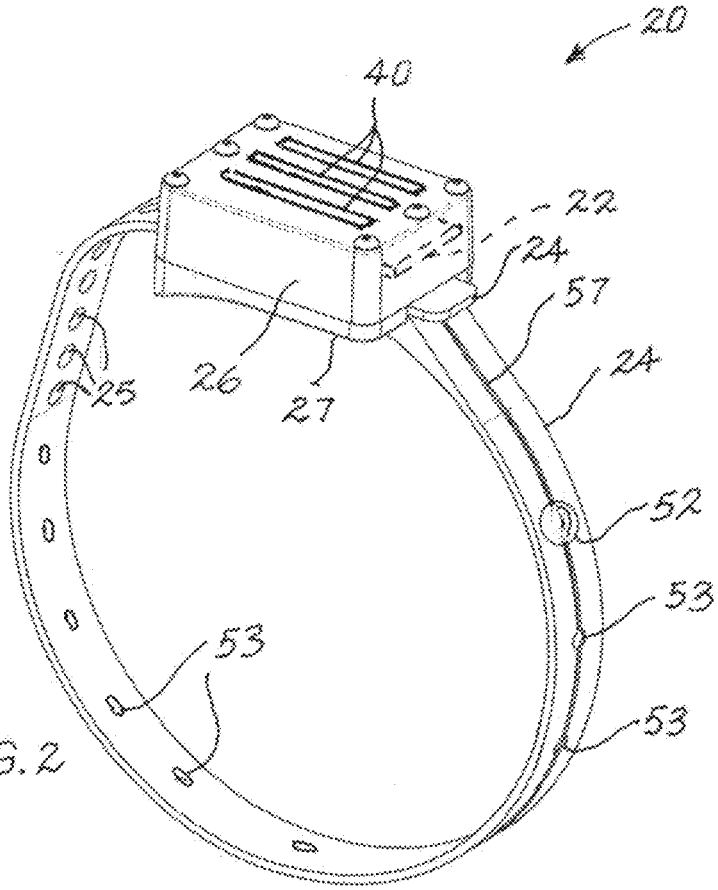
FIG. 2 is an example perspective view of an embodiment of a lighting set thereof.
Figure 5:
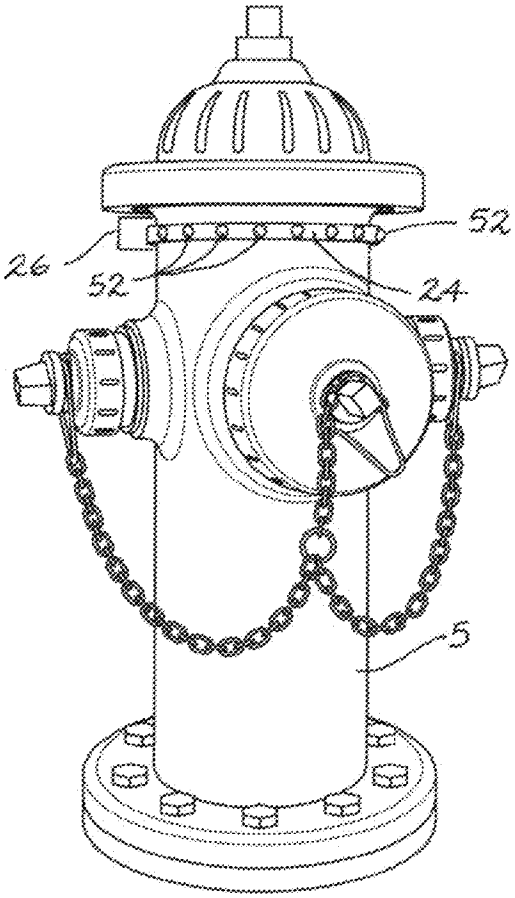
FIG. 5 is an example perspective view of the lighting set mounted on a hydrant.

In an embodiment shown in FIG. 2, each lighting set 20, may include a first electrical circuit 22, a mounting band 24 having lamps 52 mounted on it, and a weather-proof enclosure 26 which encloses circuit 22 and has an integrated solar battery charger 40. FIG. 5 shows band 24 with lamps 52 encircling hydrant 5. Band 24 may have a series of mounting holes 25 any one of which may be mechanically secured inside enclosure 26 so as to adjust band 24 to fit tightly around hydrant 5. Lamps 52 may be light emitting diode types (LEDs) which may be mounted to band 24 through small apertures 53 and may be electrically interconnected as shown using electrical conductors 57 on or within band 24.

Figure 6:
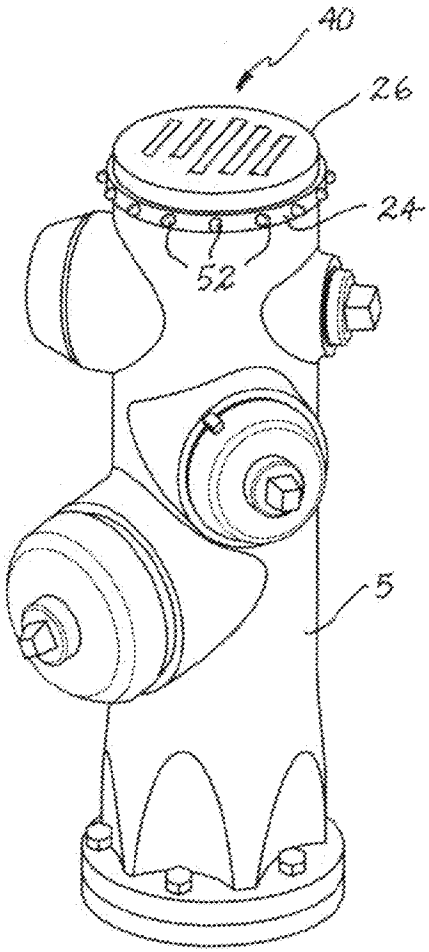
FIG. 6 is an example perspective view of an alternate lighting set mounted on a hydrant.

In an embodiment shown in FIG. 6, the enclosure 26 with circuit 22 and battery charger 40 may be mounted directly to hydrant 5 while band 24 with lamps 52 may be separately secured in place around hydrant 5 by a mechanical means of choice.

Figure 4:
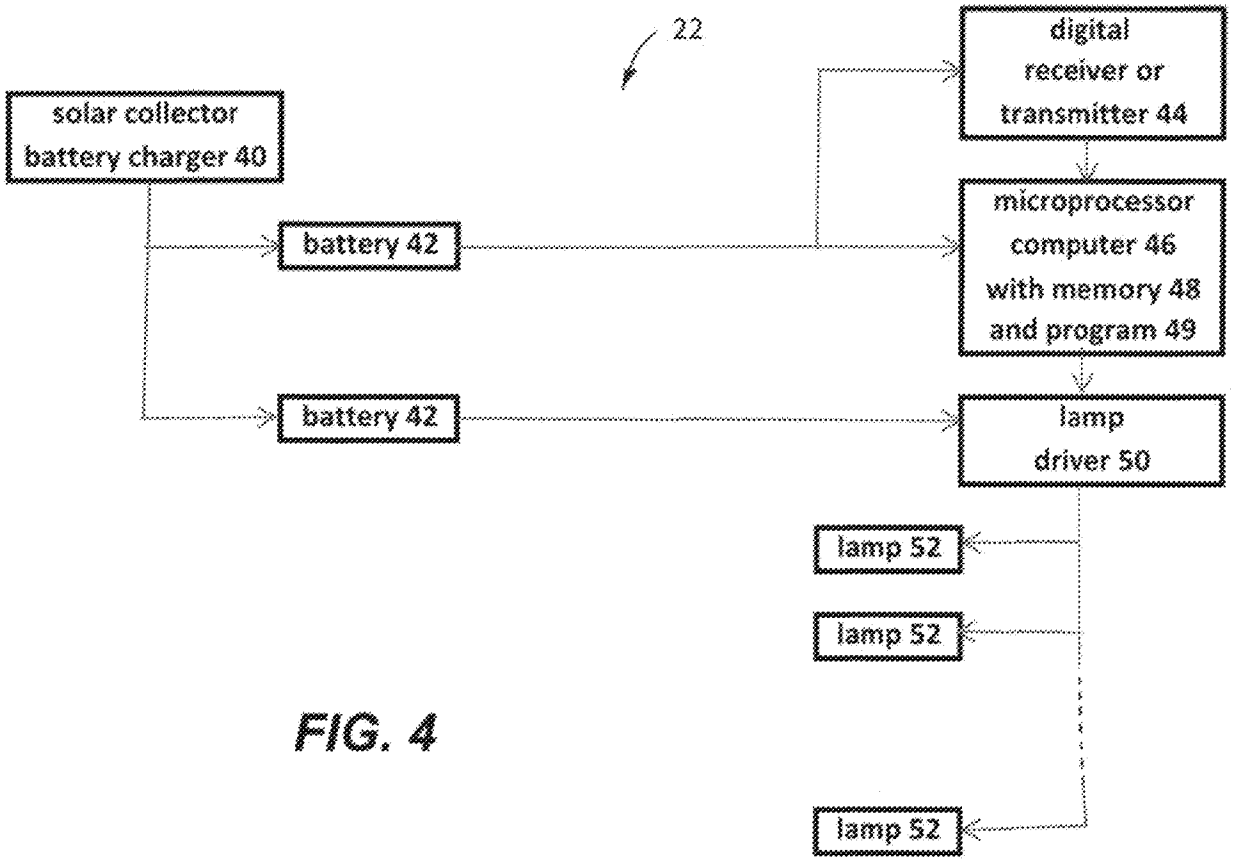
FIG. 4 is an example block diagram of an electrical circuit thereof.

The electrical block diagram of FIG. 4 represents the circuit 22 described above. As shown, circuit 22 may include the charger 40, two rechargeable batteries 42, and a digital RF transmitter 44. The term "transmitter" as used herein shall mean not only an RF transmitter, but also an RF receiver or an RF transceiver. A digital microprocessor computer 46 with a digital memory 48 storing a computer process program 49, a lamp driver 50, and a plurality of the lamps 52 complete the circuit 22. Charger 40 maintains batteries 42 at full charge. The several elements of circuit 22 are well known in the art. However, the combination of these elements and the arrangement thereof is considered to be novel and not obvious to one of skill in the art.

When transmitter 44 receives an RF signal it provides a digital signal to microprocessor 46 directing it to initiate the process program 49 which then signals lamp driver 50 with a lamp operating code. Driver 50 then delivers voltage to lamps 52 illuminating them in a blink sequence rate according to the code. The program 49 may be pre-set to deliver an instruction to driver 50 to illuminate the lamps 52 in a blinking sequence representing the code as for instance, for hydrants 5 with at least 20 PSI water pressure, the lamps will blink constantly at a rate of two blinks per second. For hydrants 5 with less than 20 PSI water pressure, the lamps will blink more slowly, once per second, for example, and with hydrants 5 with a very high water pressure, the lamps will blink rapidly, for example, four times per second. Therefore, with lamp color and blink rate an appropriate hydrant may be quickly selected by a responder appropriate for a corresponding situation.

Figure 3A:
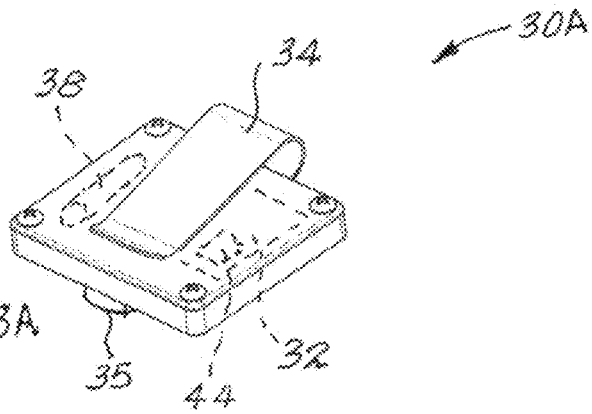
FIG. 3A is an example perspective view of a controller thereof.

In an embodiment of the reconnaissance system shown in FIG. 3A, the mobile controller 30 may include a circuit having a transmitter 44, a battery 38 and a actuation button 35 for manual actuation of an RF signal. The signal may be received by transmitter 44 of the circuits 22 of one or more lighting sets 20. The controller 30 may use a visor clip 34 to secure it within a responding vehicle 7.

Figure 3B:
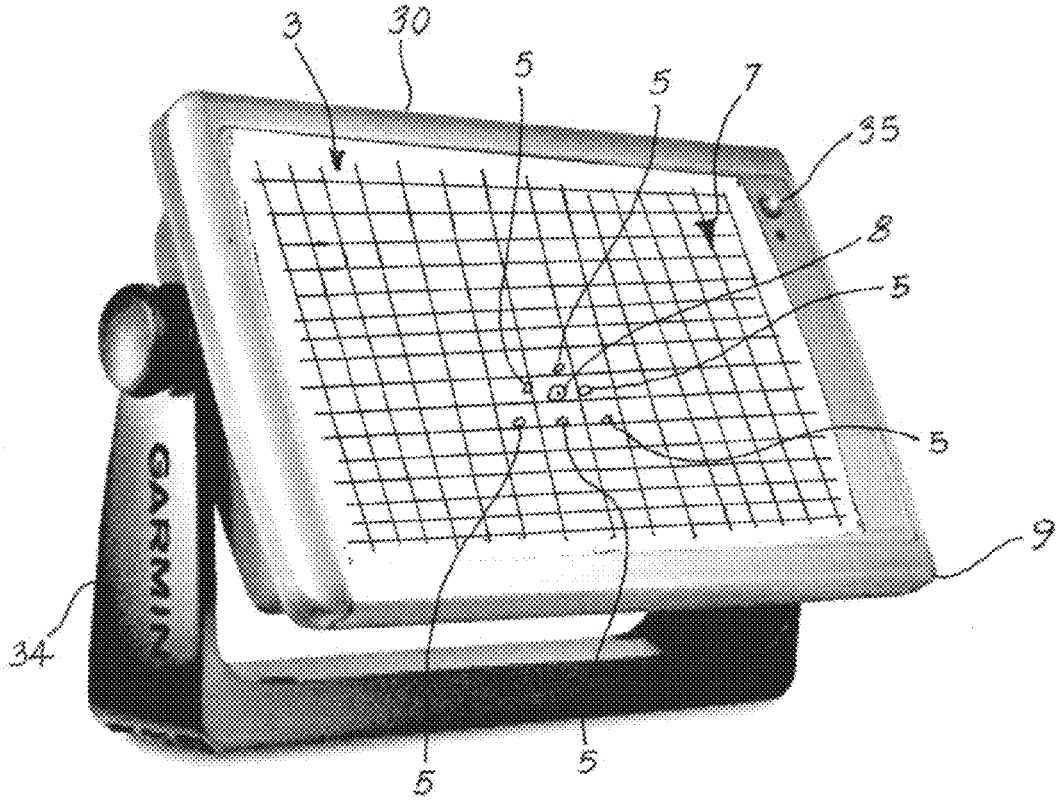
FIG. 3B is an example perspective view of an alternate controller thereof.

In an embodiment of the reconnaissance system shown in FIG. 3B, the mobile controller 30 may be integrated into a commercial vehicular mobile navigator 9 such as the Garmin navigator shown. Such a satellite navigation system typically uses a GPS navigation device to acquire position data to locate the user and a user's destination on a road map in the unit's map database. Alternately, the mobile navigator 9 may use coordinates acquired from the cellular phone network to provide user and destination locations on a screen displayed map as illustrated in FIG. 3B.

Figure 7:
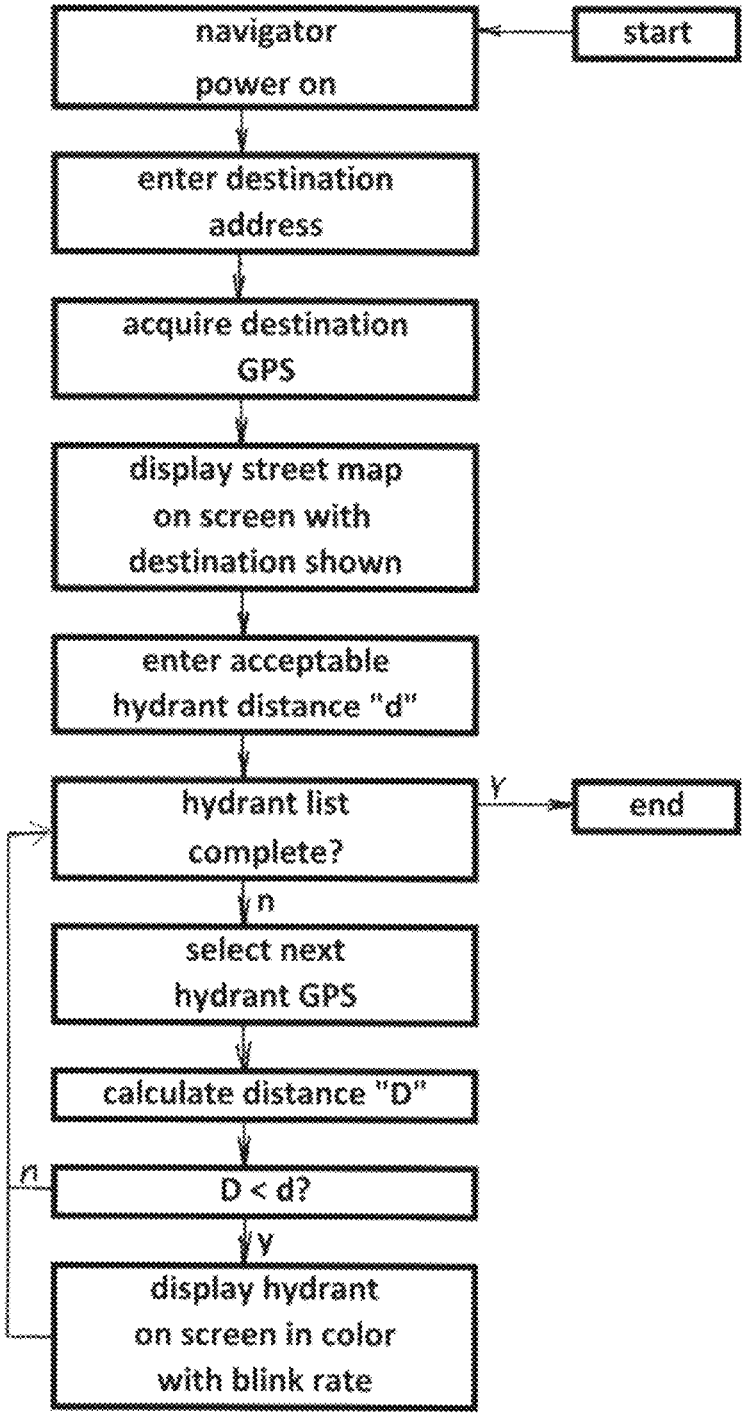
FIG. 7 is an example logic flow diagram of a method of use of the alternate controller of FIG. 3B.

As previously discussed, the mobile controller 30 may include an RF digital transmitter 44 capable of transmitting an RF signal that is able to be received by an RF digital receiver 44 in lighting set 20. Controller 30 may also include information in digital form concerning the GPS location, maximum flow rate, and water pressure, of every fire hydrant 5 within the geographical area served by a responder. This information may also include, for each hydrant 5, a hydrant lamp color related to water flow rate and a lamp blink rate related to hydrant water pressure. When this information is integrated into the database of navigator 9 the navigator's microprocessor is able to display hydrant locations, color, and blink rate on screen, overlaying a street map of the destination (location of the fire). FIG. 7 shows the steps taken to achieve the hydrant display on the navigator's street map. In FIG. 7 we see that with the navigator 9 powered on, the user may enter a destination address whereupon the destination's GPS coordinates are retrieved from the navigator's database. The street map with the destination displayed at center is positioned. Next, the user enters a distance "d" that hydrants may located from the destination. This distance depends on the water pressure generally available to hydrants in the vicinity of the destination. There may be several hundred or even thousands of hydrants 5 in the geographical service area of a specific responder but there may be as few as only one hydrant 5 near enough to the destination to be useful. It is critically important for the responders to determine which hydrants 5 are available to the destination. As discussed, the hydrants within the geographical service area are stored in the navigator's database. As shown in FIG. 7, each hydrant in the database is considered in sequence. The GPS location of each hydrant is compared with the GPS location of the destination and only hydrants having a distance "D" less than "d" are imaged on screen at their respective positions. In FIG. 3B there are six hydrants 5 shown. The hydrants 5 are shown as dots on screen and the dots are presented in a color representing the hydrant's maximum water flow rate. The dots are also presented with a blink rate representing water pressure as previously described.

Such a navigator 9 typically is capable of displaying a selected area 3 of a city from data stored in its built-in or on-line digital memory. Also, a selected destination 8, for instance a fire scene, may be displayed on screen by a mark as a circle with a dot at its center, for instance, as well as the present location of the responding vehicle 7 in which the navigator 9 is mounted. In an embodiment, fire hydrant location information is also stored in the memory of the navigator 9 and this information may be displayed on the screen as well. In an assigned response area of a given responder the locations of all fire hydrants 5 are known and are stored in the navigator's memory. The retrieval program is capable of displaying all hydrants 5 within a selected distance from a chosen fire scene 8, for instance within 1000 feet. If the location is a building, the fire hydrants 5 along the frontal street and possibly the rear street may be displayed. If the fire scene is in a grass or wooded area, the hydrants 5 in surrounding streets are displayed. The data stored in memory, beside hydrant location 5, may include hydrant operating characteristics such as flow-rate and water pressure rating. When a hydrant 5 is displayed on the screen of navigator 9, the location may be identified by a dot (5) as shown, the water pressure by a blank rate of the dot (5), and the water pressure by the color of the dot (5). Other means for identifying hydrant characteristics may be employed as the foregoing is exemplary only. The important aspect is that, while in route to a fire scene, a preliminary reconnaissance may be completed so that entry to the scene and selection of a hydrant(s) may be made very quickly saving time, property, and potentially lives.

In an embodiment, hydrant characteristics such as water pressure and flow rate may be stored in memory 48 of light set 20, but may not be stored in the database of navigator 9. Assuming that both controller 30 and lighting set 20 are equipped with RF transceivers 44, when controller 30 transmits an RF signal, a response signal from set 20 will carry the hydrant characterizing information which is then received by controller 30 and displayed on the navigator's screen. In this approach, each hydrant 5 has a unique identification number. The responder transmits an RF signal with the identification number of a specific hydrant 5. Only that hydrant responds. The responder has information of the hydrants 5 in the vicinity of the destination and is able to load each hydrant's identification number in each outgoing RF signal of a sequence of such signals.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A system for remote fire hydrant reconnaissance comprising:

a lighting set adapted for being secured to a fire hydrant, the lighting set having an RF receiver, a computer apparatus, a plurality of lamps and a lamp driver, the computer apparatus including a memory device storing a software instruction program adapted for being processed by the computer apparatus, a mobile controller having an RF transmitter adapted for signaling the RF receiver;

the lamps having an illumination color related to a NFPA color associated with a water flow rating of the fire hydrant;

the instruction program including an instruction related to a water pressure rating of the fire hydrant;

the lamp driver adapted for driving the lamps at a blink rate in accordance with the instruction.

2. The system of claim 1 further comprising a band adapted for encircling the fire hydrant, and further adapted for securing the lamps and a solar collector to the fire hydrant.

3. The system of claim 1 further comprising a band adapted for encircling the fire hydrant, and further adapted for securing the lamps to the fire hydrant wherein the lamps are arranged in a linear array on the band.

4. The system of claim 1 wherein the lighting set further comprises a first battery interconnected with the RF receiver and the computer apparatus and a second battery interconnected with the lamp driver.

5. The system of claim 1 wherein the mobile controller is integrated in a mobile navigator, the mobile navigator enabled for displaying a street map including a fire destination and fire hydrants near the fire destination.

6. A method of remote fire hydrant reconnaissance comprising:

securing an RF receiver, a computer apparatus, a plurality of lamps and a lamp driver to a fire hydrant;

securing a mobile controller having an RF transmitter adapted for signaling the RF receiver within a mobile responder;

transmitting an RF signal from the RF transmitter to the RF receiver;

in response to the RF signal, illuminating the lamps in a NFPA color associated with a water flow rating of the fire hydrant; and in response to the RF signal, illuminating the lamps at a blink rate in accordance with an instruction of a software instruction set in a memory device of the computer apparatus.

7. The method of claim 6 further comprising encircling the fire hydrant with a band securing the lamps and a solar collector to the fire hydrant.

8. The method of claim 7 further comprising securing the lamps to the band with the lamps arranged in a linear array on the band.

9. The method of claim 6 further comprising interconnect the RF receiver and the computer apparatus with a first battery, and interconnecting a second battery with the lamp driver.

10. The method of claim 6 further comprising integrating the mobile controller in a mobile navigator and adapting the mobile navigator for displaying a street map including a fire destination and fire hydrants near the fire destination.

11. A method of remote fire hydrant reconnaissance comprising:

securing an first RF transceiver, a computer apparatus, a plurality of lamps and a lamp driver to a fire hydrant;

securing a second RF transceiver in a mobile responder;

transmitting an RF signal from the second RF transceiver to the first RF transceiver;

in response to the RF signal, illuminating the lamps in a NFPA color associated with a water flow rating of the fire hydrant;

in response to the RF signal, illuminating the lamps at a blink rate in accordance with an instruction of a software instruction set in a memory device of the computer apparatus; and transmitting a further RF signal from the first RF transceiver to the second RF transceiver, the further RF signal having a fire hydrant location information a water flow rate information and a water pressure rating information, said information related to the fire hydrant; and displaying the fire hydrant location, flow and pressure information on a navigator screen of the mobile responder.

12. The method of claim 11 further comprising representing the fire hydrant location by a dot on the navigator screen.

13. The method of claim 12 further comprising representing the fire hydrant flow information by a color of the dot on the navigator screen.

14. The method of claim 12 further comprising representing the fire hydrant pressure information by a blink rate of the dot on the navigator screen.

* * * * *